US005127677A

United States Patent [19]

Merry

[11] Patent Number: 5,127,677

[45] Date of Patent: Jul. 7, 1992

[54] MEANS FOR SECURING SEQUENTIAL PAGES OF A BOOK

[75] Inventor: Trevor Merry, Nepean, Canada

[73] Assignee: Canadian Bank Note Company, Limited, Ottawa, Canada

[21] Appl. No.: 634,055

[22] Filed: Dec. 26, 1990

[51] Int. Cl.[5] ..... B42D 15/00

[52] U.S. Cl. ..... 283/92; 281/15.1; 281/38; 283/36; 283/37; 283/38; 283/40; 283/39

[58] Field of Search ..... 283/36, 37, 38, 39, 283/40, 41, 42, 43, 44, 72, 92; 281/15.1, 38

[56] References Cited

U.S. PATENT DOCUMENTS 4,300,791 11/1981 Bohrer et al. ..... 283/38
4,355,824 10/1982 Weber et al. ..... 283/40 X
4,427,290 1/1984 Kaye et al. ..... 283/117 X

*Primary Examiner*—Paul A. Bell

*Attorney, Agent, or Firm*—Barrigar & Oyen

[57] ABSTRACT

The invention relates to security means for securing the sequential order of the pages of a book such as a passport, or other such security document, by enabling the convenient detection of any removed pages through a visual inspection of the book. Specifically, the invention provides a means of marking the unbound edges of the pages of a book whereby any subsequently missing page(s) may be detected upon a visual review of the unbound side of the book. The tamper-proof comprises a plurality of pages, a spine at a first side of the pages and a visually detectable marking on each one of successive ones of the pages at the outer edge of the side which is opposite the first side. The markings collectively depict a visual image across the outer edges of the opposite sides of the pages such that the absence of any one of the successive pages is identifiable upon viewing the image. Preferably, the markings are printed by means of invisible fluorescent ink.

4 Claims, 1 Drawing Sheet

MEANS FOR SECURING SEQUENTIAL PAGES OF A BOOK

FIELD OF THE INVENTION

The invention relates to security means for securing the sequential order of the pages of a book such as a passport, or other such security document, by enabling the convenient detection of any removed pages through a visual inspection of the book. Specifically, the invention provides a means of marking the unbound edges of the pages of a book whereby any subsequently missing page(s) may be detected upon a visual review of the unbound side of the book.

BACKGROUND

Typically, passports are required by travellers to enter and/or exit foreign countries. Passports are individually issued and the identification of the passport holder is generally secured by a variety of means so as to prevent the use of false passports. However, means for securing the personal identification information of a passport alone is sometimes insufficient to satisfy a country's security requirements. For some countries, the integrity of the passport book itself, specifically the individual pages of the book, is an important consideration. For example, country "X" may consider it important to know whether a traveller has previously visited country "Y" in which case country "X" would be careful to review the pages of the traveller's passport for any visa issued by country "Y". On occasion, passport books are tampered with by their holders to remove and sometimes replace pages comprising visas; unless the sequential order of the pages of a passport book are secured to enable the detection of any such removed or replaced pages, it is difficult to identify whether a passport has been tampered with in such manner.

The present invention provides a security means for enabling the detection of missing or replaced pages of a book by simply viewing the unbound side of the book.

SUMMARY OF THE INVENTION

In accordance with the invention, there is provided a tamper-proof book of which missing or replaced pages may be visually detected. The book comprises a plurality of pages, a spine at a first side of the pages and a visually detectable marking on each one of successive ones of the pages at the outer edge of the side which is opposite the first side. The markings collectively depict a visual image across the outer edges of said opposite sides of said pages such that the absence of any one of said successive pages is identifiable upon viewing said image.

Preferably the markings are printed by means of invisible fluorescent ink such that the image is only viewable upon shining an ultraviolet light over the opposite sides of the pages of the book. The placement of each marking on each successive page may be linearly progressive such that the image is a diagonal stripe extending across the opposite sides of the pages from the front of the book to the back of the book. Alternatively, the markings may be made by means of non-contact printing applied to the opposite sides of the pages while the book is in a curved position such that the markings are printed not only on the sides of the pages but also on the outer edges of the pages. The markings may collectively depict a readable message when the book is curved to expose the outer edges of the opposite sides of the pages.

SUMMARY OF THE DRAWINGS

A more detailed description of the invention is described below (under the following heading) with reference to the following drawings in which like numerals refer to like elements throughout.

DETAILED DESCRIPTION OF THE INVENTION

Figure 1:
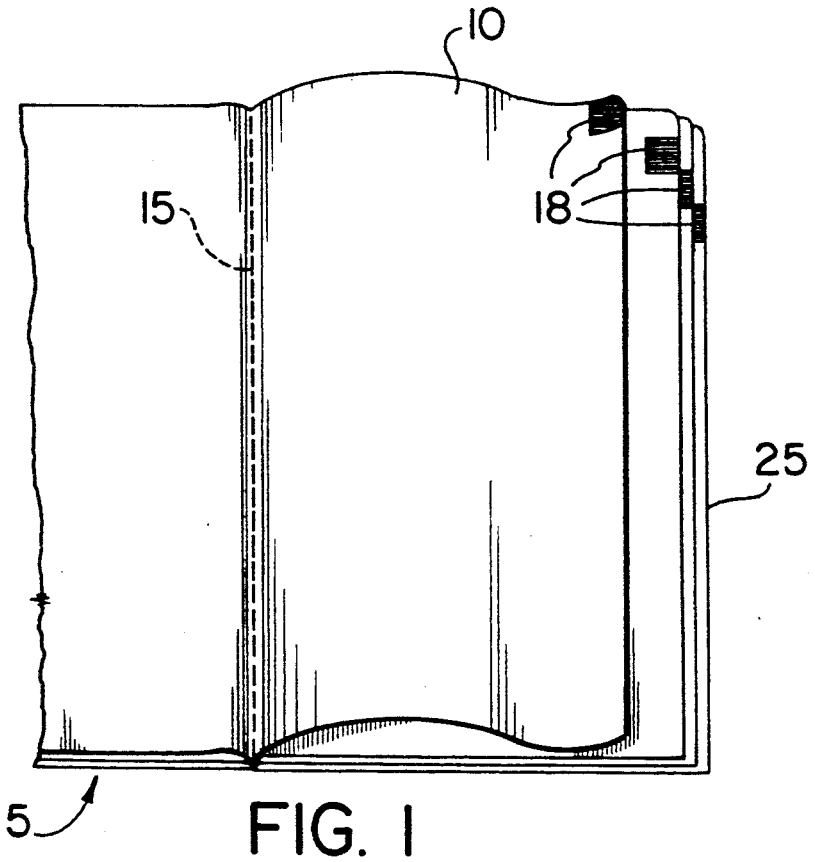
FIG. 1 is a front view of an opened passport book comprised according to one embodiment of the invention wherein each right-hand-side page of the book is marked at a different, linearly progressive position along the edge of the unbound side of the book.

The invention is a means of marking the unbound side edges of the pages of a security book, such as a passport, in such a manner that a visual inspection of the book is sufficient to determine whether a page is missing or has been replaced. FIG. 1 of the drawings shows one embodiment of the invention which is particularly useful where the security markings are desired to be printed prior to assembly of the book while FIG. 2 of the drawings shows another embodiment for use in cases where the markings are to be applied to an already assembled book.

Figure 2:
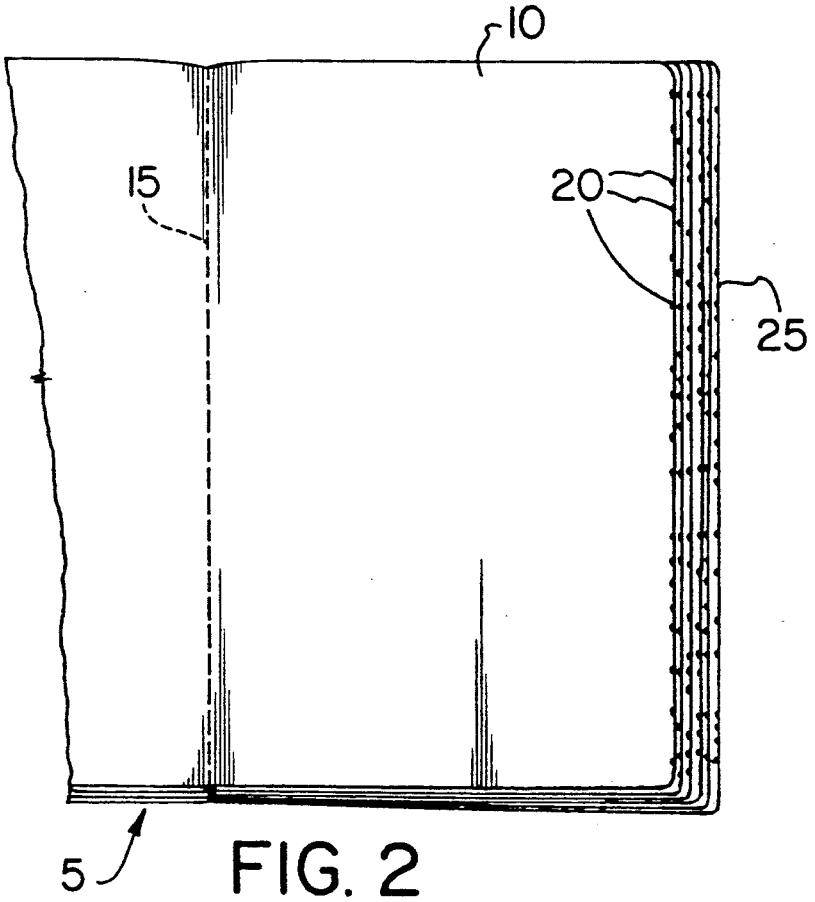
FIG. 2 is a front view of an opened passport book comprised according to another embodiment of the invention wherein the right-hand-side page edges of the book are, together, marked with a message such that each page comprises a discrete portion of the message.

In the embodiments of both FIGS. 1 and 2 the tamperproof (secured) book 5 (e.g. a passport) includes a plurality of pages 10, a spine 15 at the left side of the pages 10, and visually detectable markings 18, 20 on each successive page 10 at the outer edges 25 opposite the spine 15. The markings 18, 20 collectively depict a visual image across the page edges 25 such that the absence of any one of the successive pages 10 is identifiable upon viewing the image. In FIG. 1, the placement of the markings 18 is linearly progressive such that the image, as seen upon viewing the unbound side of book 5, is a stripe extending from the top front of the book to the bottom back of the book. The stripe (referred to as a "Sequential Page Notation Stripe" by the applicant) is formed by the continuum of discrete line segments of the markings at the outer edge 25 of each page 10. The shape and page location of the markings 18 in this embodiment may be readily identified before the assembly of the pages 10 to form the book 5 and, therefore, the markings may be conveniently printed on the pages 10 prior to such assembly. To form a continuous stripe image the markings 18 should overlap by a small amount so as to allow for inaccuracies in the book manufacturing process For example, if there are 24 pages to be marked and the length of the side of the book is 125 mm each marking might be of a length slightly more than 5.2 mm (125 mm+24), for example, 6 mm. The markings 18 may be simple blocks as illustrated in Figure or may form part of a larger pattern extending over part or all of the pages.

In the embodiment of FIG. 2, the markings 20 are made by means of non-contact printing, such as inkjet or laser printing, applied to the unbound side of the book while the book is in a curved position such that the markings 20 are printed not only on the (outer) sides 25 of the pages but also on the outer edges of the pages.

The printing, which forms the markings 20, may be a readable message, e.g. "John Doe No. GB525", such that the image of the markings 20, as seen upon curving and viewing the unbound side of book, is the printed message.

Since the image created by the markings 18, 20 at the unbound side of the book is, whether it be a stripe or message, comprised of all of the markings, collectively, the absence of any one marking is noticeable upon visually inspecting the image because of the gap created in the image by such missing marking. Thus, if any page 10 were to be removed from the book 5, and possibly be replaced by another unmarked page, a visual inspection of the book 5 according to the foregoing would suffice to detect the fact of any such tampering.

Preferably, the markings 18,20 are printed by means of invisible fluorescent ink (i.e. an ink containing a fluorescent pigment which becomes visible to the human eye only upon illuminating the ink with ultraviolet light) according to conventional means and practices used in the security printing industry. In such embodiment, the inspection of the side of the book must be coupled with a shining of ultraviolet light on the side of the book (in the case of the embodiment of FIG. 1) or on the outer page edges and side of the curved book (in the case of the embodiment of FIG. 2).

I claim:

1. A tamper-proof book of which missing or replaced pages may be visually detected comprising:

(a) a plurality of pages positioned one over another;

(b) a spine securing the first sides of said pages, the sides of said pages opposite said spine being vertically aligned to form a vertical side opposite said spine; and, (c) visually detectable markings on each of said pages at said vertically aligned sides, whereby said markings collectively depict a visual image across said vertical side such that the absence of any one of said pages is identifiable upon viewing said image and said markings are printed by means of invisible fluorescent ink such that said image is only viewable upon shining an ultraviolet light over said vertical side of said book.

2. A tamper-proof book according to claim 1 wherein the placement of each said marking on each said page is linearly progressive such that said image is a diagonal strip extending across said vertical side from the front of said book to the back of said book.

3. A tamper-proof book according to claim 1 wherein said markings are made by means of non-contact printing applied to said sides of said pages opposite said spine while said book is in a curved position such that said markings are printed not only on the sides of said pages but also on the outer edges on the faces of said pages.

4. A tamper-proof book according to claim 3 wherein said markings collectively depict a readable message when said book is curved to expose said outer edges of said faces of said pages.

* * * * *